US006698340B2

(12) United States Patent
Junk et al.

(10) Patent No.: US 6,698,340 B2
(45) Date of Patent: Mar. 2, 2004

(54) CALENDER AND PROCESS TO TREAT A MATERIAL WEB

(75) Inventors: Dieter Junk, Kreuztal (DE); Heiko Linder, Rheinberg (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/989,148

(22) Filed: Nov. 21, 2001

(65) Prior Publication Data

US 2002/0134253 A1 Sep. 26, 2002

(30) Foreign Application Priority Data

Nov. 23, 2000 (DE) ..... 100 57 991

(51) Int. Cl.[7] ..... B30B 13/00
(52) U.S. Cl. ..... 100/35; 100/163 R; 100/169
(58) Field of Search ..... 100/35, 38, 161, 100/162 R, 163 R, 163 A, 162 B, 168, 169, 155 R; 72/243, 245, 239; 29/116.2, 116.1; 162/206, 358, 359

(56) References Cited

U.S. PATENT DOCUMENTS 4,793,250 A * 12/1988 Niskanen ..... 100/35
5,029,521 A * 7/1991 Pav et al. ..... 100/38
5,123,150 A * 6/1992 Schiel ..... 492/7
5,226,357 A * 7/1993 Schiel ..... 100/47
5,438,920 A * 8/1995 Koivukunnas et al. ..... 100/38
5,662,037 A * 9/1997 van Haag ..... 100/331

FOREIGN PATENT DOCUMENTS

| | | |
|---|---|---|
| DE | 19820089 | 11/1999 |
| EP | 0679204 | 11/1995 |
| FR | 1326392 | 5/1963 |
| WO | 98/50628 | 11/1998 |

OTHER PUBLICATIONS

P. Svenka und B. Brendel, Prosoft—Die neue Glättechnologie, Wochenblatt Für Papierfafrikation Nov. 12, 1998.

* cited by examiner

*Primary Examiner*—Allen Ostrager
*Assistant Examiner*—Jimmy Nguyen
(74) *Attorney, Agent, or Firm*—Greenblum & Bernstein, P.L.C.

(57) ABSTRACT

Calender and process for treating a web with a roll stack that includes a plurality of rolls having two end rolls and several intermediate rolls arranged between the two end rolls. The plurality of rolls are arranged such that adjacent rolls, including a first and a second roll, of the plurality of rolls are positionable to form nips, and the adjacent rolls have deflections which differ from each other so that the second roll is positioned adjacent a convex side of the first roll, and the second roll has a weaker deflection than the first roll.

22 Claims, 4 Drawing Sheets

CALENDER AND PROCESS TO TREAT A MATERIAL WEB

CROSS-REFERENCE TO RELATED APPLICATIONS

The present application claims priority under 35 U.S.C. §119 of German patent application No. 100 57 991.4, filed on Nov. 23, 2000, the disclosure of which is expressly incorporated by reference herein in its entirety.

BACKGROUND OF THE INVENTION

1. Field of the Invention

The present invention relates to a calender with a roll stack, which has two end rolls and several intermediate rolls in between, whereby two rolls that are adjacent to one another, each having a deflection, form a nip in operation. Moreover, the present invention relates to a process to treat a material web, which is guided through several nips and pressurized there, whereby each nip is formed by a first roll and a second roll adjacent to it.

2. Discussion of Background Information

This type of calender is used to glaze a paper web, for example. In this connection, it is desired to achieve the most uniform possible progression of pressure over the entire width of the paper web in order to avoid differences in thickness and quality transverse to the machine direction of the paper web. The paper webs to be glazed currently have widths in an order of magnitude of up to about 10 m. As a result, the correspondingly long rolls tend to "sag" due to their dead weight in the axial center, i.e., they have a deflection. Even if this deflection isn't all that large, it becomes noticeable as an interfering factor in the pressure treatment of the paper web or another material web.

Attempts have been made to act against this phenomenon. Thus, it is known, for example, from EP 0 679 204 B 1 to select the intermediate rolls in such a way that they all have the same intrinsic deflection, and to relieve the weight of the rolls and the so-called overhanging loads, i.e., the parts connected to the rolls, such as guide rolls or bearing housing, completely in terms of weight.

Another approach, which is described in DE 198 20 089 A1, assumes that one modifies the segment load profiles by initiating deformation forces at the roll pin of the intermediate roll. In doing so, one selects the deformation forces in such a way that, in order to exercise loading or relieving pressures, the intermediate rolls receive an essentially equal deflection, whereby a degree of the deflection is set in accordance with a specific modification of a roll-induced segment load difference between the upper and lower nips. The deflection-controllable rolls at the end of the roll stack are then adapted to this curvature. It is now observed that the glazing results are unsatisfactory in some cases despite this equal deflection.

SUMMARY OF THE INVENTION

The present invention provides for designing the load in the nip to be uniform.

According to the invention, the instant invention is directed to a calender of the type described above, in which the deflections of the adjacent rolls differ from one another, such that a second roll adjacent the convex side of a first roll has a weaker deflection than the first roll.

Thus, the instant invention indeed abandons the previously pursued approach of giving all rolls the same deflection or selecting the rolls in such a way that they naturally have the same deflection. However, this opens the possibility that the deflection in the nips can be brought closer to one another than was previously the case. Playing a role in this connection is the consideration that so far one did not take the different effects that are produced on the concave and convex sides into account in the case of the deflection of a roll. If the deflections are selected so that they are different, these effects can be taken into consideration.

In this connection, it is especially preferred that the adjacent rolls each have a deflection with which an amplitude of the deflection of the surface line at the convex side of the first roll essentially coincides with an amplitude of the deflection of the surface line of the adjacent second roll at its concave side. Thus, the deflections of the two rolls, which form the nip under consideration, can be adapted to each other in the nip so that the progression of pressure in the nip is essentially more uniform over the width of the material web. The adaptation will take place there where it is required. In this connection, it can be accepted without hesitation that the deflections of the two rolls as such, i.e., the deflection at the axes, deviate from one another. This type of deviation is even a prerequisite that brings the deflections at the two surface lines into conformity with one another.

It is preferred that at least one of the rolls that are adjacent to one another have a force initiation device. One is then no longer dependent upon selecting rolls that naturally have the required deflections. One can also bring about this type of deflection by initiating external forces.

The amplitude $f_{EM_{(i+1)}}$ of the deflection of the second roll is preferably a function of the amplitude $f_{EM_{(i)}}$ of the deflection of the first roll in accordance with the following relationship:

$$f_{EM_{(i+1)}} = \sqrt{\left(\frac{2}{D_{(i+1)}K^2}\right)^2 + \frac{4}{D_{(i+1)}K^2} \cdot f_{EU_{(i)}}} - \frac{2}{D_{(i+1)}K^2}$$

whereby $$f_{EU_{(i)}} = f_{EM_{(i)}} - \frac{1}{4}K^2 \cdot f_{EM_{(i)}}^2 \cdot D_{(i)}; \text{ and}$$

$$K = \frac{16}{AB} \cdot \frac{1 + 3MbML - \frac{AB}{AB}}{5 + 12MbML - \frac{AB}{AB}}$$

AB=Machine width

MbML=Bearing distance $D_{(i)}$=Diameter of the first roll $D_{(i+1)}$=Diameter of the second roll i=Index of the first roll i+1=Index of the second roll The adjacent rolls preferably have different bearing distances if they deviate from one another in terms of at least one parameter. With this embodiment not just conformity of the deflections, or, more precisely, of the amplitudes of the deflections at the two adjacent surface lines of the two rolls forming the nip, are achieved, but there is also the opportunity to set equal elastic lines. As is generally known, the elastic lines are not just dependent upon the amplitude of the deflection, but, for example, also upon the curve shape of the elastic line, which, via thrust deformation, for example, depends upon the slenderness degree of the rolls. If one now has an opportunity to vary the bearing distances of the intermediate rolls, one then obtains the opportunity to actually also adapt the curve shape of the elastic lines of the surface lines to one another better, i.e., of the two lines limiting the nip.

The difference of the bearing distances preferably lies in a range of about 0.1% to about 2% as related to the greater bearing distance. This type of deviation is entirely tolerable. Greater deviations in the bearing arrangement are not required, because the forces that act on the bearing arrangement do not receive any essentially different points of application of force. Despite this, considerable advantages can be achieved with these small changes.

In this connection, it is preferred that the bearing distance of at least one intermediate roll can be changed. After replacing the affected roll, it is then possible to bring the elastic line into the desired shape, if necessary.

In this case, it is preferred that the seating of all rolls be accomplished symmetrically to the axial center. This also applies to the intermediate rolls, whose bearing distance is adjusted. This means though that one must undertake the adjustment of the bearing at both axial ends. The bend of the surface line of this roll is then adjusted to the bend of the corresponding second roll over the entire machine width.

Moreover, the instant invention is directed to a process of the type generally discussed above, in which deflections of the two rolls are selected so that they are different.

As explained above in connection with the calender, with different deflections of the rolls, i.e., their surface lines, it is possible to adjust the deflections to one another at the decisive locations, namely at the surface lines forming the nip. In this way, the glazing result is improved drastically over the machine width, i.e., the width of the material web.

In this connection, it is preferred that one control the deflection of the first roll in such a way that the amplitude of the deflection of the surface line at the convex side of the first roll coincides with the amplitude of the deflection of the surface line at the concave side of the second roll. If the deflections are brough into conformity, an improved work result over of the width of the rolls is obtained.

It is also advantageous if, in the case of unequal rolls, the bearing distance of one roll is set so that it deviates from the bearing distance of the other roll. As explained above, not only the amplitude of the deflection at the two surface lines can be brought into conformity in this way, but also the curve shape of the elastic line.

Accordingly, the instant invention is directed to a calender with a roll stack that includes a plurality of rolls having two end rolls and several intermediate rolls arranged between the two end rolls. The plurality of rolls are arranged such that adjacent rolls, including a first and a second roll, of the plurality of rolls are positionable to form nips, and the adjacent rolls have deflections which differ from each other so that the second roll is positioned adjacent a convex side of the first roll, and the second roll has a weaker deflection than the first roll.

In accordance with a feature of the instant invention, the nips can be formed during operation of the calender.

According to another feature of the invention, the adjacent rolls each have a deflection with which an amplitude of a deflection of a surface line at the convex side of the roll can essentially coincide with an amplitude of a deflection of a surface line of a concave side of the second roll.

According to still another feature of the present invention, at least one of the adjacent rolls may include a force initiation device.

Further, an amplitude $f_{EM_{(i+1)}}$ of the deflection of the second roll can be a function of an amplitude $f_{EM_{(i)}}$ of the deflection of the first roll in accordance with the following relationship:

$$f_{EM_{(i+1)}} = \sqrt{\left(\frac{2}{D_{(i+1)}K^2}\right)^2 + \frac{4}{D_{(i+1)}K^2} \cdot f_{EU_{(i)}}} - \frac{2}{D_{(i+1)}K^2}$$

whereby $$f_{EU_{(i)}} = f_{EM_{(i)}} - \frac{1}{4}K^2 \cdot f_{EM_{(i)}}^2 \cdot D_{(i)}; \text{ and}$$

$$K = \frac{16}{AB} \cdot \frac{1 + 3MbML - \frac{AB}{AB}}{5 + 12MbML - \frac{AB}{AB}},$$

AB=Machine width

MbML=Bearing distance $D_{(i)}$=Diameter of the first roll $D_{(i+1)}$=Diameter of the second roll i=Index of the first roll i+1=Index of the second roll Still further, if the adjacent rolls deviate from one another in terms of at least one parameter, the adjacent rolls can be arranged to have different bearing distances. A difference between the bearing distances of the adjacent rolls may be within a range of about 0.1% to about 2% with respect to a greater bearing distance. Further, at least one of the adjacent rolls can be structured and arranged to have an adjustable bearing distance. The at least one adjacent roll may include one of the plurality of intermediate rolls.

According to a further feature of the instant invention, all of the plurality of rolls can be arranged symmetrically to an axial center in a seating.

The present invention is directed to a process to treat a material web. The process includes forming a plurality of nips between a plurality of adjacent rolls, where the plurality of adjacent rolls include first and second rolls, and selecting, for the first and second rolls of at least one of the plurality of adjacent rolls, a deflection for the first roll which is different from a deflection of the second roll. The process also includes guiding the web through the plurality of nips, and pressing the web in the plurality of nips.

According to a feature of the instant invention, the process can also include controlling the deflection of the first roll so that an amplitude of the deflection of a surface line at a convex side of the first roll coincides with an amplitude of a deflection of a surface line at a concave side of the second roll.

Moreover, the process can include, in an event unequal rolls, setting a bearing distance of one of the adjacent rolls to deviate from a bearing distance of the other of the adjacent rolls.

The present invention is directed to a calender that includes a plurality of rolls arranged in a roll stack, the plurality of rolls including two end rolls and several intermediate rolls arranged between the two end rolls. The plurality of rolls include a first roll and a second roll positioned adjacent each other in the roll stack, the first roll having a deflection which differs from the second roll, and the first roll and the second roll being positionable to form a nip.

According to a feature of the present invention, the deflection of the first roll can be selected so that a convex surface of the first roll conforms to a concave surface of the second roll. Further, the deflection of the first roll is selected to be greater than a deflection of the second roll.

In accordance with another feature of the invention, the deflection of the second roll is selected so that a concave surface of the second roll conforms to a convex surface of the first roll.

The present invention is directed to a process for treating a web in a calender having a plurality of rolls arranged in a roll stack, the plurality of rolls including two end rolls and several intermediate rolls arranged between the two end rolls. The process includes arranging a first roll and a second roll of the plurality of rolls, which have deflections which differ from each other, adjacent each other in the roll stack, and positioning the first roll and the second roll to form a nip.

According to a feature of the invention, the process can further include selecting the deflection of the first roll so that a convex surface of the first roll conforms to a concave surface of the second roll. Further, the deflection of the first roll may be greater than a deflection of the second roll.

In accordance with yet another feature of the present invention, the process can also include selecting the deflection of the second roll so that a concave surface of the second roll conforms to a convex surface of the first roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 1A shows, in general, a calender 1 formed by a roll stack having two end rolls 2 and 3 and several, e.g., three intermediate rolls 4, 5, and 6, positioned between end rolls 2 and 3. As is generally known, upper end roll 2 is fixed on a frame 7 and lower end roll 3 is supported on a hydraulic piston-cylinder-device 8. Moreover, intermediate rolls 4, 5, and 6 are supported on levers 9, 10, and 11 that can be pivoted about pivots 12, 13, and 14 on frame 7. Each lever 9- 11 is provided with a respective force transmission device 15, 16, and 17.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
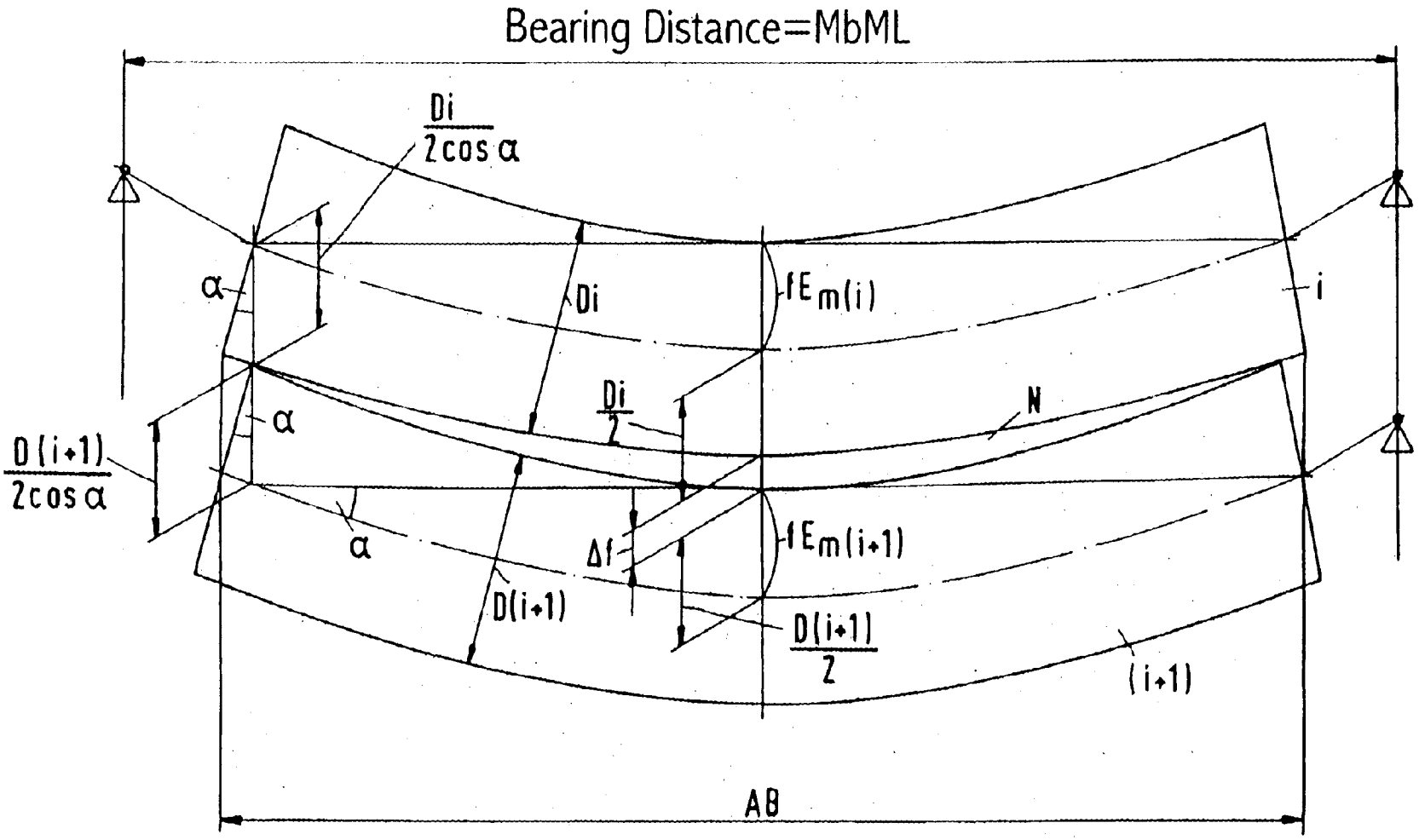
FIG. 1 illustrates a first schematic diagram to explain important quantities in accordance with the instant invention.
Figure 1A:
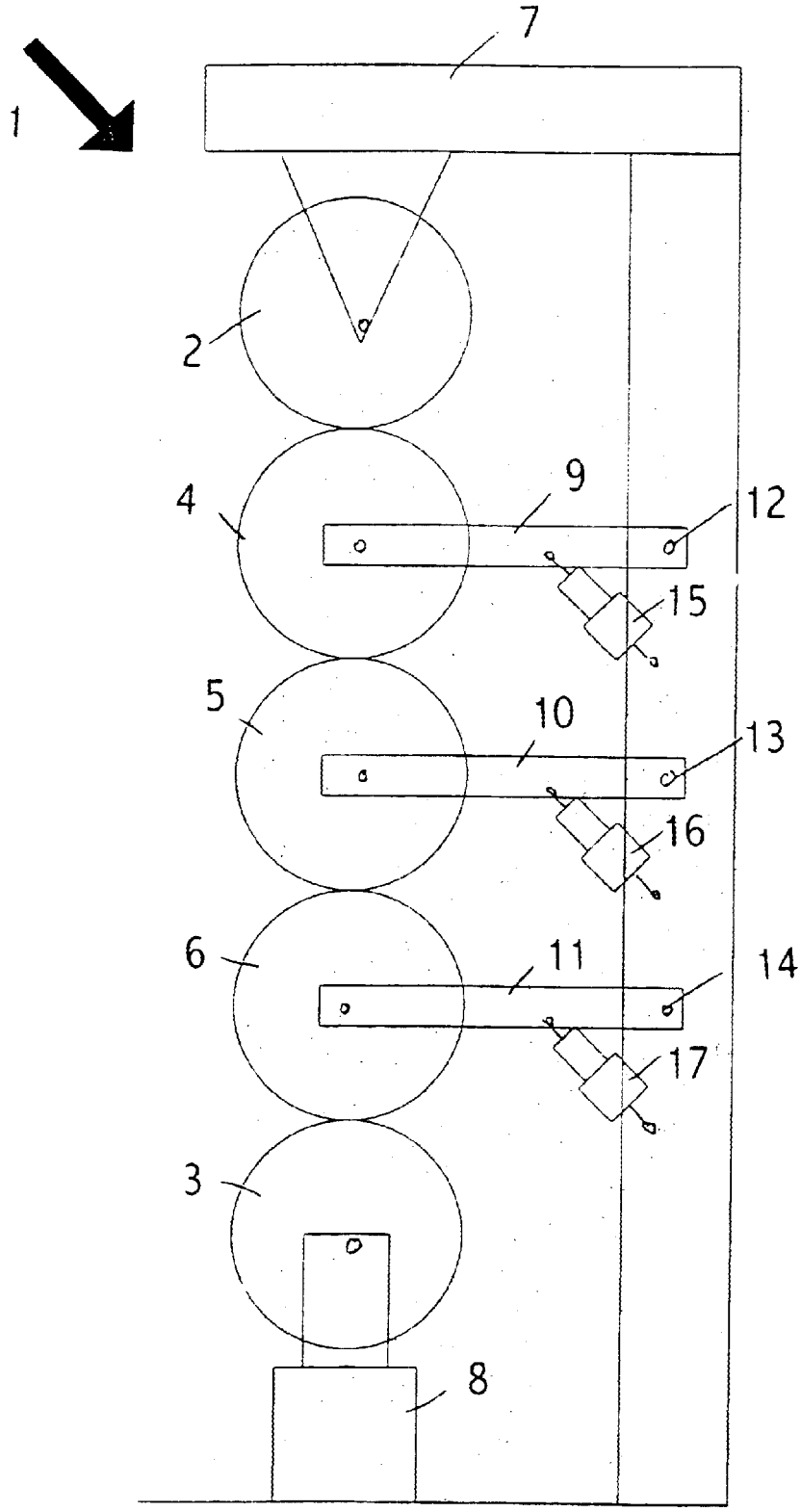
FIG. 1A illustrates a schematic diagram of a calender.
Figure 2:
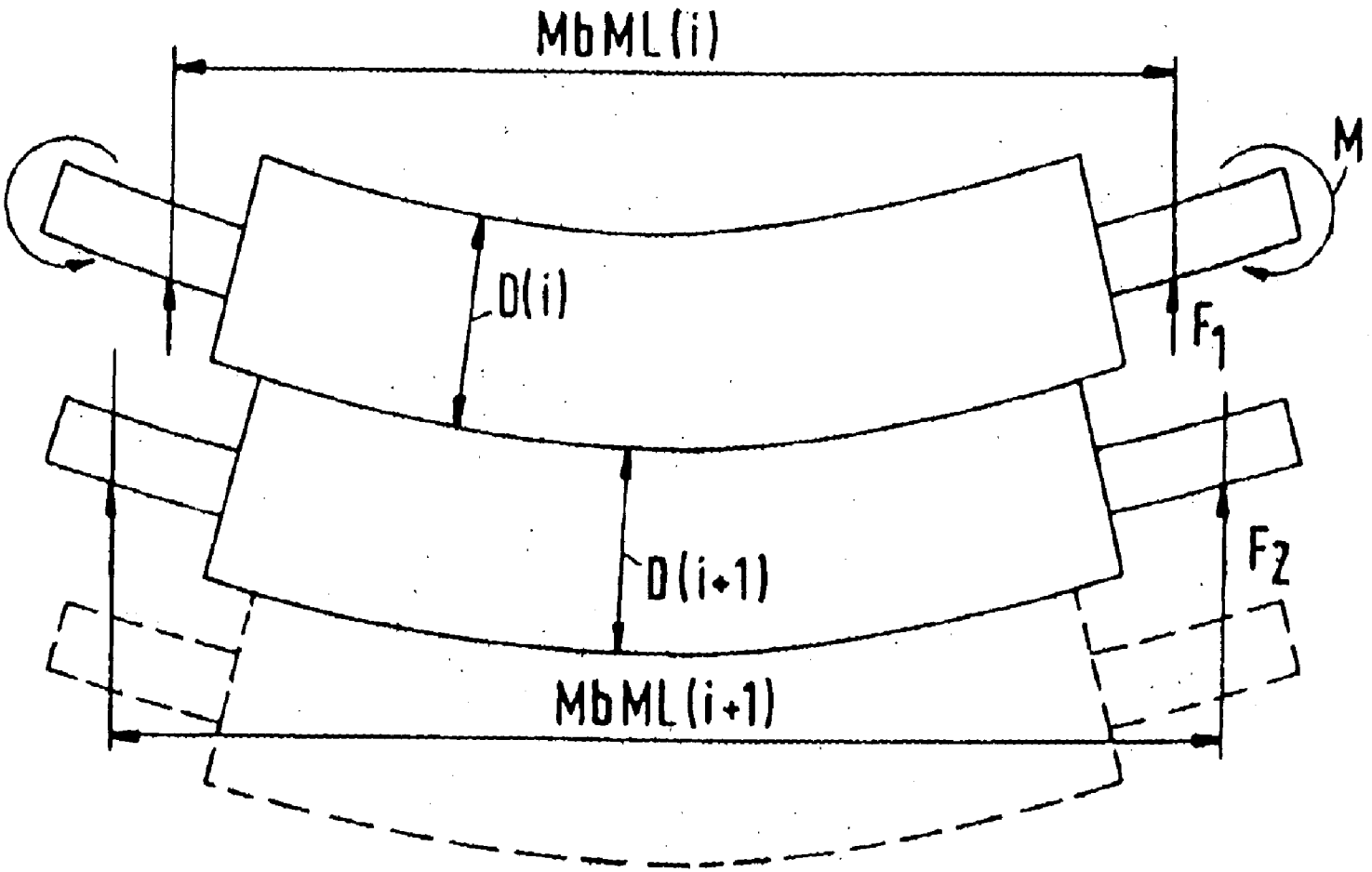
FIG. 2 illustrates a second schematic diagram to explain additional quantities according to the invention.

FIG. 1 shows a section of a roll stack of a calender. A first roll i and second roll i+1, which together form a nip N, are shown. In operation, a material web, for example a paper web that is not shown in more detail, is guided through this nip N and pressurized there and if necessary also bombarded with increased temperature. In this connection, it is desired that the treatment take place uniformly over the entire width of the nip N (i.e., the extension in the axial direction of the two rolls i, i+1). A prerequisite for this is that the two rolls i, i+1 are also able to form the nip N uniformly.

In order to achieve this type of uniform formation, the two rolls i, i+1 have different deflections. In doing so, the deflections are selected in accordance with a specific procedure, which is supposed to be explained in the following. The goal is adapting the deflection of the lower surface line of the upper roll i to the deflection of the upper surface line of the lower roll i+1. In this connection, it is assumed in a simplified way that the deflection is caused exclusively by gravitational force and the associated weight forces at the rolls. However, the considerations are applicable, as a rule, even if external forces or moments cause the deflection.

The point of departure for the following observation is the opened roll stack, i.e., the center rolls i, i+1 sag freely, supported in their bearings, corresponding to their intrinsic elastic lines of gravitational force and rigidity. In this connection, the shape of a parabola is produced at least in the first approximation. It suffices, for the following observation, however, if one views the deflection line as a circular line.

For the closing process of the nips, it is considered ideal if the contact lines of the two rolls forming the nip N, which are to be moved on top of one another, have an optimum conforming shape. The two contact lines are the lower surface line of the upper roll and the upper surface line of the lower roll. In this connection, it is largely independent of whether the roll weight is partially or fully compensated in the subsequent operational case.

The requirement that the lower surface line of roll i correspond in terms of its deflection amplitude $f_{EU_i}$ to the deflection amplitudes $f_{EO_{(i+1)}}$ of the upper surface line of the roll (i+1) located underneath cannot be met in the case of exactly the same intrinsic deflections $f_{EM}$ of the adjacent center rolls i and i+1, as can be derived on the basis of the diagram in FIG. 1.

Based upon the same elastic lines, the distance XR of the rolls at the barrel edges:

$$XR = \frac{1}{2\cos\alpha}(D_i + D(i+1))$$

is equal to the distance XM of the rolls in the roll center:

$$XM = \frac{1}{2}(D_i + D(i+1)) + \Delta f$$

i.e., the roll gap difference Δf=XR-XM produces:

$$\Delta f = \frac{1}{2}(D_i + D_{(i+1)})\left(\frac{1}{\cos\alpha} - 1\right)$$

According to generally known formulae, a fixed relationship (when neglecting the thrust deformation) exists between the deflection $f_{EM}$ and the angle of inclination at of the intrinsic elastic line at the barrel edge:

$$f_{EM} = \frac{9E \cdot AB^4}{384EJ}\left(5 + 12 \cdot \frac{MbML - AB}{AB}\right)$$

$$\tan\alpha = \frac{9E \cdot AB^3}{24EJ}\left(1 + 3 \cdot \frac{MbML - AB}{AB}\right)$$

It follows from this that:

$$\tan\alpha = \frac{16}{AB} \cdot \frac{1 + 3\frac{MbML - AB}{AB}}{5 + 12\frac{MbML - AB}{AB}} \cdot f_{EM} = K \cdot f_{EM}$$

Moreover, the following applies:

$$\frac{1}{\cos\alpha} = \sqrt{1 + \tan^2\alpha}$$

Since $\tan^2\alpha$ a will always be very small as compared to 1, the following applies as a permissible simplification:

$$\sqrt{1 + \tan^2\alpha} = 1 + \frac{1}{2}\tan^2\alpha$$

Therefore:

$$\Delta f = \frac{1}{4}K^2 \cdot f_{EM}^2 (D_i + D_{(i+1)})$$

In order to obtain the ideal conformance, i.e., $\Delta f=0$, the deflection $f_{EM}$ of roll i+1 must be purposefully smaller than that of the superjacent roll i. If the amplitude of the deflection of the lower surface line of the upper roll i is designated by i with $f_{EU_i}$ and the amplitude of the deflection of the upper surface line of the lower roll i+1 is designated by $f_{EO_{(i+1)}}$ the following should apply:

$$f_{EU_i} = f_{EO_{(i+1)}}$$

The quantities $f_{EU_i}$ and $f_{EO_{(i+1)}}$ can be derived in accordance with the following relationships:

$$f_{EU_i} = f_{EM_i} - \frac{1}{4}K^2 \cdot f_{EM_i}^2 \cdot D_i$$

$$f_{EO_{(i+1)}} = f_{EM_{(i+1)}} - \frac{1}{4}K^2 \cdot f_{EM_{(i+1)}}^2 \cdot D_{(i+1)}$$

It follows from this that:

$$f_{EM_{(i+1)}} = f_{EU_i} - \frac{1}{4}K^2 \cdot f_{EM_{(i+1)}}^2 \cdot D_{(i+1)}$$

If this expression is solved in accordance with $f_{EM_{(i+1)}}$, one gets:

$$f_{EM_{(i+1)}} = \sqrt{\left(\frac{2}{D_{(i+1)} \cdot K^2}\right)^2 + \frac{4}{D_{(i+1)} \cdot K^2} \cdot f_{EU_i}} - \frac{2}{D_{(i+1)} \cdot K^2}$$

whereby $f_{EU_i}$ was defined above.

As a result, if one begins with the uppermost center roll of a calender (i=2), one can calculate the entire roll stack with respect to its ideally differing intrinsic deflections. This is set forth in the following table, whereby the following applies:

AB=10,000 mm
MbML=11,700 mm

| Roll Position | Nominal Diameter D | $f_{EM/mm}$ | $f_{EU/mm}$ | $\Delta f_{EM/mm}$ to roll 2 |
|---|---|---|---|---|
| 2 | 760 | 2.37000 | 2.36987 | 0 |
| 3 | 825 | 2.36974 | 2.36960 | 0.00026 |
| 4 | 760 | 2.36948 | 2.36935 | 0.00052 |
| 5 | 825 | 2.36921 | 2.36908 | 0.00079 |
| 6 | 825 | 2.36894 | 2.36880 | 0.00106 |
| 7 | 760 | 2.36868 | 2.36855 | 0.00132 |
| 8 | 825 | 2.36842 | 2.36828 | 0.00158 |
| 9 | 760 | 2.36816 | 2.36803 | 0.00184 |
| 10 | 825 | 2.36789 | 2.36776 | 0.00211 |
| 11 | 760 | 2.36763 | — | 0.00237 |

The roll stack has 12 rolls, i.e., two end rolls with adjustable deflections and intermediate rolls in between at roll positions 2–11, which are formed alternatingly as hard or soft rolls in a known manner. In this case, the hard rolls are chill cast rolls with diameters of 760/410 mm (outside diameter/inside diameter), and the soft rolls are formed as gray cast iron tube rolls with a plastic covering and have a diameter of 825/800/428 mm (outside diameter with covering/outside diameter without covering/inside diameter).

One sees that, in the case of the $11^{th}$ roll, a deviation $\Delta f_{EM}$ of 0.00237 mm to roll 2 is yielded.

This first approach has already largely proven itself. However, in this connection, primarily only the amplitudes of the deflections are adapted to one another.

One can further improve the evening out of the stress in the nip by selecting or adjusting different bearing distances for the center rolls. The adjustment can be necessary, for example, after a roll has been changed.

As a rule, adjacent rolls in multi-roll calenders are not equal to one another. This applies not only to the first and last nip, which as a rule are limited or defined by an intermediate or center roll and a deflection adjusting roll, but also to the remaining nips, which are always limited by two intermediate rolls. For example, the elastic rolls, i.e., the roll with an elastic surface, and the hard rolls, i.e., the rolls with an inflexible or hard surface, have different slenderness degrees and roll diameters. The slenderness degree is yielded by dividing the outside diameter Da by the machine width AB.

The thrust deformation of a roll is a function f of the slenderness degree $$\frac{Da}{AB},$$

among others. The thrust deformation, however, also influences the curve shape of the elastic line (FIG. 3) in accordance with the following equation for the curve factors between the roll center (y=1 with x=0) and the edge of the machine width (y=0 with x=½ AB).

$$y = 1 - 4\frac{x^2}{AB^2} \cdot \frac{6 - 4\frac{x^2}{AB^2}12\frac{MbML - AB}{AB} + f\left(\frac{Da^2}{AB^2}\right)}{5 + 12\frac{MbML - AB}{AB} + f\left(\frac{Da^2}{AB^2}\right)}$$

with MbML as the bearing distance (center to the center of the bearing).

In the case of a common bearing distance MbML of center rolls with unequal $$f\left(\frac{Da^2}{AB^2}\right)$$

Figure 3:
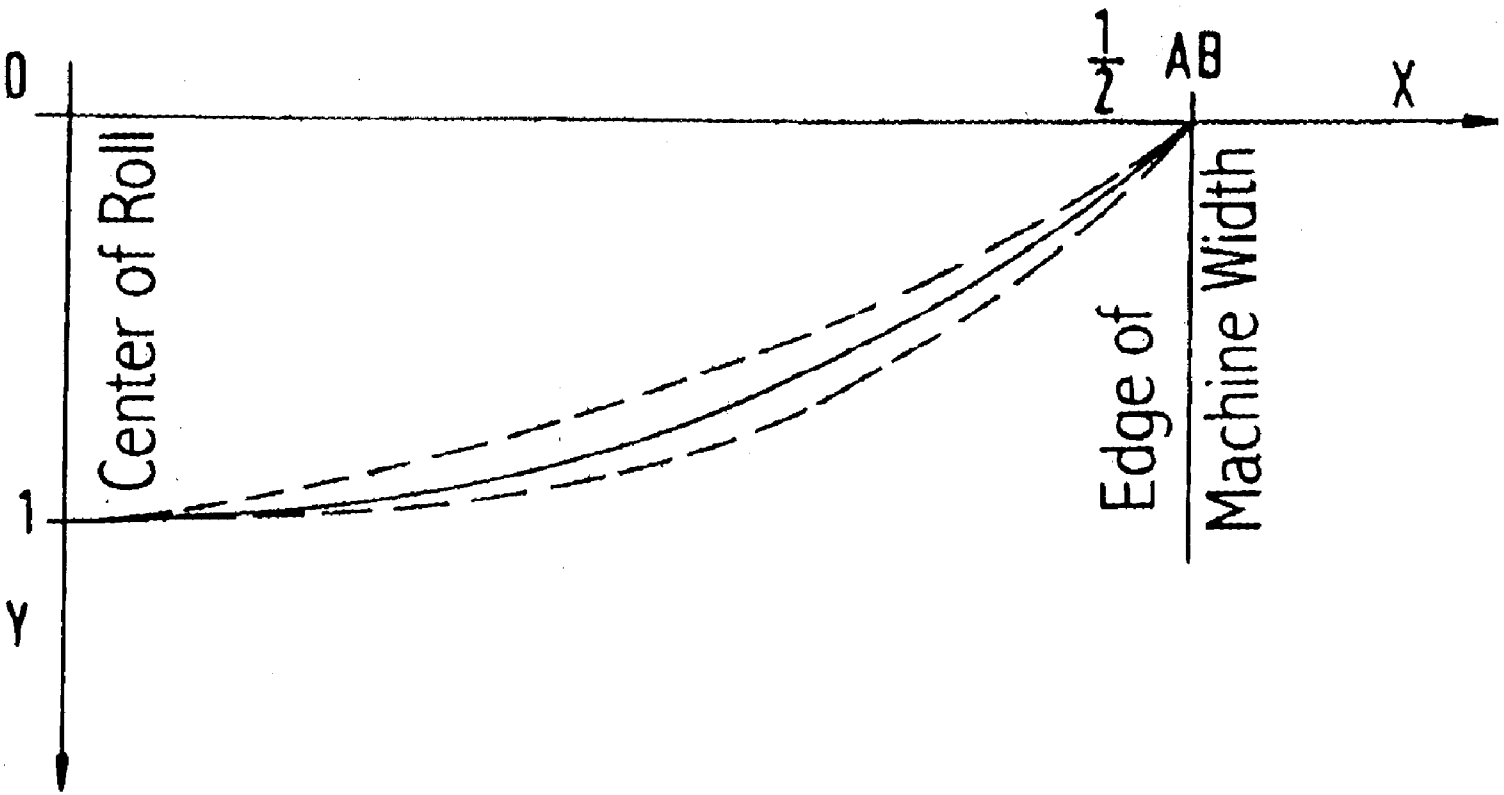
FIG. 3 illustrates a schematic representation of elastic lines.

(definition further below), deviating curve shapes of their elastic lines are automatically yielded, as is evident from the schematic representation in FIG. 3.

Even if the deflection amplitudes in the roll centers coincide, in some circumstances the feared M-profile or W-profile can be produced in the segment load progression of the roll gap. In fact these are already weakened if one adapts the deflection amplitudes to one another. An improvement is yielded, however, if one correspondingly selects the bearing distances MbML.

In this connection, it is assumed that the machine width AB remains the same for all nips N. The following then applies for two adjacent rolls i and i+1:

$$12\frac{MbML_{(i+1)} - AB}{AB} + f\left(\frac{Da_i + 1^2}{AB^2}\right) = 12\frac{MbML_i - AB}{AB} + f\left(\frac{Da_i^2}{AB^2}\right)$$

or is solved in accordance with $MbML_{(i+1)}$:

$$MbML_i + 1 + \frac{AB}{12}\left(\frac{12}{AB}(MbML_i - AB) + f\left(\frac{Da_i^2}{AB^2}\right) - f\left(\frac{Da_{(i+1)}^2}{AB^2}\right)\right) + AB$$

Besides being a function of the slenderness degree $$\frac{Da}{AB},$$

the thrust deformation also depends upon the thrust distribution value κ of the roll cross section, the transverse strain value $\mu$ of the roll material, and the diameter ratio $$\frac{Di}{Da}$$

with hollow bore hole Di as follows:

$$f\left(\frac{Da^2}{AB^2}\right) = 6(1+\mu)\kappa\left(1 - \frac{Di^2}{Da^2}\right)\frac{Da^2}{AB^2}$$

These considerations are supposed to be explained on the basis of the following example.

| | | |
|---|---|---|
| Example | AB | = 6,360 mm |
| | $MbML_i$ | = 7,500 mm |
| Roll 1: | $Da_i$ | = 560 mm |
| Material = Chill cast | | |
| | $Di_i$ | = 250 mm |
| | $\kappa_i$ | = 2.01 |
| | $\mu_i$ | = 0.25 |
| Roll 2: | $Da_{(i=1)}$ | = 477 mm |
| Material = Steel (the elastic covering is not taken into consideration) | | |

-continued

| | | |
|---|---|---|
| | $Di_{(i+1)}$ | = 327 mm |
| | $\kappa_{(i+1)}$ | = 2.07 |
| | $\mu_{(i+1)}$ | = 0.30 |
| Results | $MbML_{(i+1)}$ | = 7,517.4 mm |

⇒ ΔL ≈ 17.5 mm

One sees that a distance in the order of magnitude of 17.4 mm is obtained. This is an entirely feasible order of magnitude.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A calender with a roll stack, comprising:

a plurality of rolls including two end rolls and several intermediate rolls arranged between said two end rolls;

said plurality of rolls being arranged such that adjacent rolls, comprising a first and a second roll, of said plurality of rolls are positionable to form nips; and said adjacent rolls have deflections which differ from each other so that said second roll is positioned adjacent a convex side of said first roll, and said second roll has a weaker deflection than said first roll.

2. The calender in accordance with claim 1, wherein said nips are g operation of said calender.

3. The calender in accordance with claim 1, wherein at least one of said adjacent rolls includes a force initiation device.

4. The calender in accordance with claim 1, wherein, when said adjacent rolls deviate from one another in terms of at least one parameter related to roll deflection, said adjacent rolls are arranged to have different bearing distances.

5. The calender in accordance with claim 4, wherein a difference between the bearing distances of said adjacent rolls is within a range of about 0.1% to about 2% with respect to a greater bearing distance.

6. The calender in accordance with claim 4, wherein at least one of said adjacent rolls is structured and arranged to have an adjustable bearing distance.

7. The calender in accordance with claim 1, wherein all of said plurality of rolls are arranged symmetrically to an axial center in a seating.

8. A calender with a roll stack, comprising:

a plurality of rolls including two end rolls and several intermediate rolls arranged between said two end rolls;

said plurality of rolls being arranged such that adjacent rolls, comprising a first and a second roll, of said plurality of rolls are positionable to form nips; and said adjacent rolls have deflections which differ from each other so that said second roll is positioned adjacent a convex side of said first roll, and said second roll has a weaker deflection than said first roll, wherein said adjacent rolls each have a deflection with which an amplitude of a deflection of a surface line at said convex side of said roll essentially coincides with an amplitude of a deflection of a surface line of a concave side of said second roll.

9. A calender with a roll stack, comprising:

a plurality of rolls including two end rolls and several intermediate rolls arranged between said two end rolls;

said plurality of rolls being arranged such that adjacent rolls, comprising a first and a second roll, of said plurality of rolls are positionable to form nips; and said adjacent rolls have deflections which differ from each other so that said second roll is positioned adjacent a convex side of said first roll, and said second roll has a weaker deflection than said first roll, wherein an amplitude $f_{EM_{(i+1)}}$ of the deflection of said second roll is a function of an amplitude $f_{EM_{(i)}}$ of the deflection of said first roll in accordance with the following relationship:

$$f_{EM_{(i+1)}} = \sqrt{\left(\frac{2}{D_{(i+1)}K^2}\right)^2 + \frac{4}{D_{(i+1)}K^2} \cdot f_{EU_{(i)}}} - \frac{2}{D_{(i+1)}K^2}$$

whereby $$f_{EU_{(i)}} = f_{EM_{(i)}} - \frac{1}{4}K^2 \cdot f_{EM_{(i)}}^2 \cdot D_{(i)}; \text{ and}$$

$$K = \frac{16}{AB} \cdot \frac{1 + 3MbML - \frac{AB}{AB}}{5 + 12MbML - \frac{AB}{AB}},$$

AB=Machine width

MbML=Bearing distance $D_{(i)}$=Diameter of said first roll $D_{(i+1)}$=Diameter of said second roll i=Index of said first roll i=1=Index of said second roll.

10. A calender with a roll stack, comprising:

a plurality of rolls including two end rolls and several intermediate rolls arranged between said two end rolls;

said plurality of rolls being arranged such that adjacent rolls, comprising a first and a second roll, of said plurality of rolls are positionable to form nips; and said adjacent rolls have deflections which differ from each other so that said second roll is positioned adjacent a convex side of said first roll, and said second roll has a weaker deflection than said first roll.

wherein, when said adjacent rolls deviate from one another in terms of at least one parameter, said adjacent rolls are arranged to have different bearing distances, wherein at least one of said adjacent rolls is structured and arranged to have an adjustable bearing distance, and wherein said at least one adjacent roll comprises one of said plurality of intermediate rolls.

11. A process to treat a material web, said process comprising:

forming a plurality of nips between a plurality of adjacent rolls, the plurality of adjacent rolls comprising first and second rolls;

selecting, for the first and second rolls of at least one of said plurality of adjacent rolls, a deflection for said first roll which is different from a deflection of the second roll, so that the second roll has a weaker deflection than the first roll and is positioned adjacent a convex side of the first roll;

guiding the web through the plurality of nips; and pressing the web in the plurality of nips.

12. The process in accordance with claim 11, further comprising, in an event unequal rolls, setting a bearing distance of one of the adjacent rolls to deviate from a bearing distance of the other of the adjacent rolls.

13. A process to treat a material web, said process comprising:

forming a plurality of nips between a plurality of adjacent rolls, the plurality of adjacent rolls comprising first and second rolls;

selecting, for the first and second rolls of at least one of said plurality of adjacent rolls, a deflection for said first roll which is different from a deflection of the second roll;

guiding the web through the plurality of nips;

pressing the web in the plurality of nips; and controlling the deflection of the first roll so that an amplitude of the deflection of a surface line at a convex side of the first roll coincides with an amplitude of a deflection of a surface line at a concave side of the second roll.

14. A process to treat a material web, said process comprising:

forming a plurality of nips between a plurality of adjacent rolls, the plurality of adjacent rolls comprising first and second rolls;

selecting, for the first and second rolls of at least one of said plurality of adjacent rolls, a deflection for said first roll which is different from a deflection of the second roll;

guiding the web through the plurality of nips: and pressing the web in the plurality of nips wherein an amplitude $f_{EM_{(i+1)}}$ of the deflection of the second roll is a function of an amplitude $f_{EM_{(i)}}$ of the deflection of the first roll in accordance with the following relationship:

$$f_{EM_{(i+1)}} = \sqrt{\left(\frac{2}{D_{(i+1)}K^2}\right)^2 + \frac{4}{D_{(i+1)}K^2} \cdot f_{EU_{(i)}}} - \frac{2}{D_{(i+1)}K^2}$$

whereby $$f_{EU_{(i)}} = f_{EM_{(i)}} - \frac{1}{4}K^2 \cdot f_{EM_{(i)}}^2 \cdot D_{(i)}; \text{ and}$$

$$K = \frac{16}{AB} \cdot \frac{1 + 3MbML - \frac{AB}{AB}}{5 + 12MbML - \frac{AB}{AB}},$$

AB=Machine width

MbML=Bearing distance $D_{(i)}$=Diameter of the first roll $D_{(i+1)}$=Diameter of the second roll i=Index of the first roll i+1=Index of the second roll.

15. A calender, comprising:

a plurality of rolls arranged in a roll stack, said plurality of rolls comprising two end rolls and several intermediate rolls arranged between said two end rolls;

said plurality of rolls comprising a first roll and a second roll positioned adjacent each other in said roll stack, said first roll having a deflection which differs from said second rolls, and said second roll being positioned adjacent a convex side of said first roll; and said first roll and said second roll being positionable to form a nip.

16. The calender in accordance with claim 15, wherein the deflection of said first roll is selected so that a convex surface of said first roll conforms to a concave surface of said second roll.

17. The calender in accordance with claim 16, wherein the deflection of said first roll is selected to be greater than a deflection of said second roll.

18. The calender in accordance with claim 15, wherein the deflection of said second roll is selected so that a concave surface of said second roll conforms to a convex surface of said first roll.

19. A process for treating a web in a calender having a plurality of rolls arranged in a roll stack, the plurality of rolls including two end rolls and several intermediate rolls arranged between the two end rolls, said process comprising:

arranging a first roll and a second roll of the plurality of rolls, which have deflections which differ from each other, adjacent each other in the roll stack, such that the second roll is positioned adjacent a convex side of the first roll; and positioning the first roll and the second roll to form a nip.

20. The process in accordance with claim 19, further comprising selecting the deflection of the first roll so that a convex surface of the first roll conforms to a concave surface of the second roll.

21. The process in accordance with claim 20, wherein the deflection of the first roll is greater than a deflection of the second roll.

22. The process in accordance with claim 19, further comprising selecting the deflection of the second roll so that a concave surface of the second roll conforms to a convex surface of the first roll.

* * * * *